US007399085B2

(12) United States Patent
Kim et al.

(10) Patent No.: US 7,399,085 B2
(45) Date of Patent: Jul. 15, 2008

(54) COOLING FAN

(75) Inventors: Wook Kim, Gyeonggi-Do (KR); Chang-Jun Kim, Seoul (KR); Ho-Seon Rew, Seoul (KR)

(73) Assignee: LG Electronics Inc., Seoul (KR)

( * ) Notice: Subject to any disclaimer, the term of this patent is extended or adjusted under 35 U.S.C. 154(b) by 201 days.

(21) Appl. No.: 11/020,247

(22) Filed: Dec. 27, 2004

(65) Prior Publication Data

US 2005/0271521 A1 Dec. 8, 2005

(30) Foreign Application Priority Data

Jun. 2, 2004 (KR) ..... 10-2004-0040112

(51) Int. Cl.
*G03B 21/16* (2006.01)

(52) U.S. Cl. ..... 353/61; 353/57; 417/423.14

(58) Field of Classification Search ..... 353/57–63, 353/77, 79, 119; 348/748
See application file for complete search history.

(56) References Cited

U.S. PATENT DOCUMENTS 6,325,597 B1 12/2001 Kim et al.
6,472,781 B2 * 10/2002 Yamamoto ..... 310/58
6,565,334 B1 * 5/2003 Bradbury et al. ..... 417/423.1
6,572,333 B2 6/2003 Fujinaka
7,110,255 B2 * 9/2006 Ko et al. ..... 361/695
2002/0171777 A1 * 11/2002 Park ..... 348/748
2003/0182954 A1 10/2003 Parker et al.
2005/0007558 A1 * 1/2005 Shiraishi et al. ..... 353/61
2005/0186096 A1 * 8/2005 Vinson et al. ..... 417/423.1

FOREIGN PATENT DOCUMENTS

CN 1271818 A 11/2000
CN 1364984 A 8/2002
CN 1386984 A 12/2002
CN 1473243 A 2/2004

* cited by examiner

*Primary Examiner*—William C. Dowling
(74) *Attorney, Agent, or Firm*—Birch, Stewart, Koalsch & Birch, LLP

(57) ABSTRACT

Disclosed is a cooling fan including a fan rotated by a motor, for forcibly circulating the air, and a fan housing having a through hole with a predetermined inside diameter so that the fan can be mounted thereon. A curvature radius of the end of the inner circumference of the through hole sucking the air is smaller than a curvature radius of the end of the inner circumference of the through hole discharging the air. As a result, the cooling fan can minimize noises in the operation.

14 Claims, 7 Drawing Sheets

| No | x | y | z |
|---|---|---|---|
| 1 | 6.651 | 17.263 | -5.58 |
| 2 | 6.681 | 17.251 | -5.288 |
| 3 | 6.493 | 17.323 | -4.879 |
| 4 | 6.107 | 17.463 | -4.372 |
| 5 | 5.538 | 17.652 | -3.785 |
| 6 | 4.804 | 17.865 | -3.134 |
| 7 | 3.926 | 18.079 | -2.434 |
| 8 | 2.925 | 18.267 | -1.699 |
| 9 | 1.829 | 18.409 | -0.944 |
| 10 | 0.699 | 18.487 | -0.153 |
| 11 | -0.402 | 18.496 | 0.654 |
| 12 | -1.469 | 18.442 | 1.479 |
| 13 | -2.478 | 18.333 | 2.299 |
| 14 | -3.411 | 18.183 | 3.087 |
| 15 | -4.252 | 18.005 | 3.818 |
| 16 | -4.987 | 17.815 | 4.462 |
| 17 | -5.607 | 17.63 | 4.99 |
| 18 | -6.098 | 17.466 | 5.371 |
| 19 | -6.451 | 17.339 | 5.578 |
| 20 | -6.651 | 17.263 | 5.58 |
| 21 | -5.926 | 20.185 | 5.381 |
| 22 | -5.239 | 22.843 | 5.316 |
| 23 | -4.603 | 25.283 | 5.241 |
| 24 | -3.923 | 27.546 | 5.147 |
| 25 | -3.075 | 29.653 | 4.965 |
| 26 | -2.095 | 31.594 | 4.73 |
| 27 | -1.019 | 33.362 | 4.474 |
| 28 | 0.103 | 34.954 | 4.224 |
| 29 | 1.239 | 36.373 | 3.994 |

| No | x | y | z |
|---|---|---|---|
| 30 | 2.359 | 37.623 | 3.791 |
| 31 | 3.436 | 38.71 | 3.619 |
| 32 | 4.445 | 39.642 | 3.474 |
| 33 | 5.364 | 40.428 | 3.322 |
| 34 | 6.174 | 41.075 | 3.164 |
| 35 | 6.919 | 41.581 | 2.954 |
| 36 | 7.895 | 41.896 | 2.405 |
| 37 | 8.844 | 42.056 | 1.775 |
| 38 | 9.515 | 42.12 | 1.307 |
| 39 | 9.756 | 42.135 | 1.137 |
| 40 | 10.049 | 42.066 | 0.633 |
| 41 | 10.734 | 41.897 | -0.194 |
| 42 | 11.765 | 41.619 | -1.28 |
| 43 | 13.099 | 41.219 | -2.551 |
| 44 | 14.695 | 40.677 | -3.93 |
| 45 | 16.505 | 39.977 | -5.341 |
| 46 | 18.482 | 39.102 | -6.716 |
| 47 | 20.573 | 38.044 | -7.992 |
| 48 | 22.721 | 36.801 | -9.121 |
| 49 | 24.868 | 35.386 | -10.063 |
| 50 | 26.971 | 33.81 | -10.842 |
| 51 | 28.92 | 32.159 | -11.534 |
| 52 | 30.657 | 30.508 | -12.188 |
| 53 | 32.155 | 28.925 | -12.793 |
| 54 | 33.396 | 27.482 | -13.348 |
| 55 | 34.371 | 26.253 | -13.851 |
| 56 | 35.071 | 25.31 | -14.3 |
| 57 | 35.49 | 24.719 | -14.69 |
| 58 | 35.611 | 24.544 | -15.018 |
| 59 | 35.613 | 24.42 | -15.025 |
| 60 | 35.583 | 24.099 | -15.039 |
| 61 | 35.419 | 23.729 | -15.032 |
| 62 | 34.953 | 23.563 | -14.954 |
| 63 | 34.012 | 23.841 | -14.742 |
| 64 | 32.818 | 24.211 | -14.456 |
| 65 | 31.42 | 24.577 | -14.105 |
| 66 | 29.83 | 24.908 | -13.686 |
| 67 | 28.064 | 25.168 | -13.194 |
| 68 | 26.143 | 25.32 | -12.632 |
| 69 | 24.094 | 25.324 | -12.002 |
| 70 | 21.951 | 25.144 | -11.314 |
| 71 | 19.754 | 24.746 | -10.581 |
| 72 | 17.538 | 24.108 | -9.815 |
| 73 | 15.349 | 23.208 | -9.041 |
| 74 | 13.238 | 22.027 | -8.291 |
| 75 | 11.121 | 20.63 | -7.498 |
| 76 | 8.922 | 19.051 | -6.597 |
| 77 | 6.651 | 17.263 | -5.58 |

COOLING FAN

BACKGROUND OF THE INVENTION

1. Field of the Invention

The present invention relates to a cooling fan, and more particularly to, a cooling fan which can reduce noises in a cooling operation in a flow system using a high static pressure by improving the structure.

2. Description of the Background Art

In general, a cooling fan is a device for preventing an apparatus from being damaged due to heat generated in the operation of the apparatus by cooling the heat. The cooling fan cools the apparatus by forcibly circulating the air by a blast force and exchanging heat between the circulated air and a heating source.

An LCD projection TV is one of the apparatuses using the cooling fan.

The LCD projection TV is an advanced audio-visual image apparatus that has been improved from a slide projector, an OHP and a full image apparatus for performing briefing or education. A computer, a camcorder, a DVD and a VTR can be connected directly to the LCD projection TV, for performing various presentations or multimedia educations by screen projection.

The cooling fan is mounted to cool heat generated by a lamp used as a light source of the projection TV.

FIG. 1 is a perspective view illustrating part of a conventional LCD projection TV using a cooling fan.

Referring to FIG. 1, the conventional LCD projection TV uses a lamp 1 having its outer circumference curved in the length direction as a light source. The lamp 1 is mounted on a lamp housing 10 to be easily replaced and handled.

High temperature heat is generated in the operation of the lamp 1. When an inside temperature of the LCD projection TV increases by the high temperature heat generated by the lamp 1, various circuits are abnormally operated. In the worst case, a circuit board is broken by overheating.

In order to solve the foregoing problem, a cooling device is disposed at the lamp housing 10, for cooling the heat generated by the lamp 1. A plurality of through holes 11 for discharging heat or exchanging heat with the open air are formed at both sides (or top and bottom surfaces) of the lamp housing 10. A cooling fan 20 for forcibly circulating the air is installed at the outer portion of the lamp housing 10, so that the air sucked through the through holes 11 formed at one side of the lamp housing 10 can efficiently exchange heat with the lamp 1.

The cooling fan 20 includes a fan 21 having a plurality of blades 23 protruded in the radial direction from an outer circumference of a hub 22 rotated by an inside motor (not shown), and a fan housing 25 having a through hole 26 formed in the thickness direction with a predetermined inside diameter, so that the fan 21 can be inserted and fixed thereto.

As illustrated in FIG. 2, in order to use the mass-produced cooling fan 20 for multipurpose, a curvature radius R1 of the curved surface of the end of the inside diameter of the inlet side contacting the lamp housing 10 and sucking the hot air generated by the lamp 1 into the fan 21 is identical to a curvature radius R2 of the curved surface of the end of the inside diameter of the outlet side externally discharging the heat absorbed air.

In the LCD projection TV using the cooling device, when the fan 21 is rotated by supplying power to the cooling fan 20 for cooling the lamp 1 that is a heating source, the air is sucked into the lamp housing 10 through the through holes 11 formed at one side of the lamp housing 10 by forcible circulation of the fan 21, absorbs the heat generated by the lamp 1, and is externally discharged from the LCD projection TV through the through hole 26 of the cooling fan 20.

Here, the cooling fan 20 must cool the lamp 1 at an optimum temperature by sufficiently circulating the air, and reduce the noises so that the user can comfortably watch the TV.

The cooling system of the LCD projection TV will now be explained. When the air is sucked through the through holes 11 of the lamp housing 10, the lamp 1 itself becomes a resistance to the air flow. In addition, the air passage is narrowed by the space occupied by the lamp 1. In order to efficiently cool the high temperature heat generated by the lamp 1 in spite of the resistance factors, the cooling fan 20 must have high static pressure and high flow rate performance.

Still referring to FIG. 2, the curvature radius R1 of the end of the inside diameter of the inlet side of the through hole 26 formed on the fan housing 25 of the cooling fan 20 is identical to the curvature radius R2 of the end of the inside diameter of the outlet side thereof. Accordingly, when the air is forcibly circulated by the cooling fan 20 and externally discharged from the TV, noises seriously increase.

FIG. 3 is a graph showing noise variations at the air inlet and outlet sides of the conventional cooling fan 20. Here, an x axis indicates a rotary frequency of the fan 21, and an y axis indicates a sound pressure level (SPL).

As shown in FIG. 3, noises N2 generated when the air is discharged to the outlet side of the cooling fan 20 are higher than noises N1 generated when the air is sucked to the inlet side of the cooling fan 20.

In addition, broad noises in a low frequency region are very high at the outlet side of the cooling fan 20. The broad noises are flow noises generated by the cooling fan 20 and have an average value of about 27 dBA, which is much larger than an average value of the noises (about 19 dBA) generated at the inlet side of the cooling fan 20. Such noises prevent the users from comfortably watching the TV.

SUMMARY OF THE INVENTION

Therefore, an object of the present invention is to provide a cooling fan which can reduce noises in the operation by improving the structure.

To achieve these and other advantages and in accordance with the purpose of the present invention, as embodied and broadly described herein, there is provided a cooling fan, including: a fan rotated by a motor, for forcibly circulating the air; and a fan housing having a through hole with a predetermined inside diameter so that the fan can be mounted thereon, wherein a curvature radius of the end of the inner circumference of the through hole sucking the air is smaller than a curvature radius of the end of the inner circumference of the through hole discharging the air.

According to another aspect of the present invention, in an LCD projection TV including a lamp disposed inside a lamp housing installed at one side of an LCD display panel and used as a light source, and a cooling fan mounted at one side of the lamp housing, for circulating the air to cool heat generated by the lamp, the cooling fan includes: a fan rotated by a motor, for forcibly circulating the air; and a fan housing having a through hole with a predetermined inside diameter so that the fan can be mounted thereon, wherein a curvature radius of the end of the inner circumference of the through hole sucking the air is smaller than a curvature radius of the end of the inner circumference of the through hole discharging the air.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
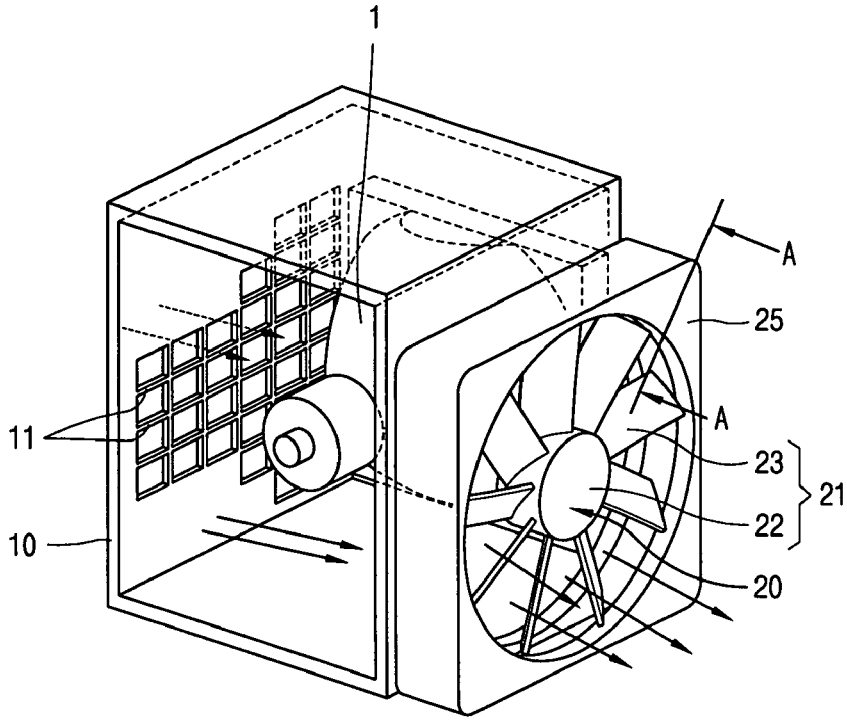
FIG. 1 CONVENTIONAL ART
FIG. 1 is a perspective view illustrating a conventional cooling fan mounting structure.
Figure 2:
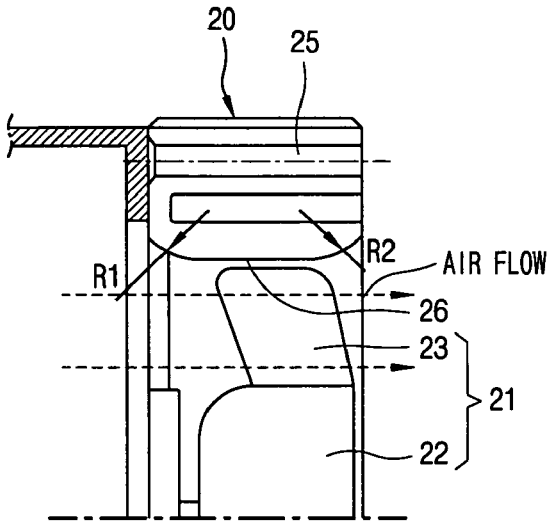
FIG. 2 CONVENTIONAL ART
FIG. 2 is a vertical-sectional view illustrating part of the cooling fan of FIG. 1.
Figure 3:
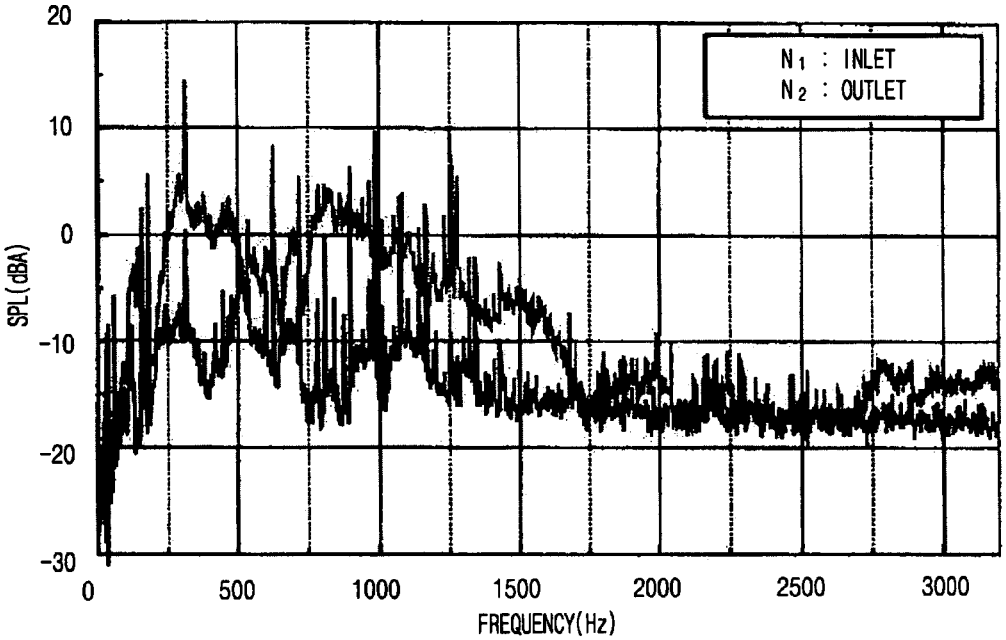
FIG. 3 CONVENTIONAL ART
FIG. 3 is a graph showing noise variations at the inlet and outlet sides of the conventional cooling fan.

Reference will now be made in detail to the preferred embodiments of the present invention, examples of which are illustrated in the accompanying drawings.

In the following description, same drawing reference numerals are used for the same elements even in different drawings.

A cooling fan in accordance with the most preferable embodiment of the present invention will now be described in detail.

It should be recognized that the scope of the present invention is not restricted to the specific embodiment described below, but modified as recited in the claims below.

Figure 4:
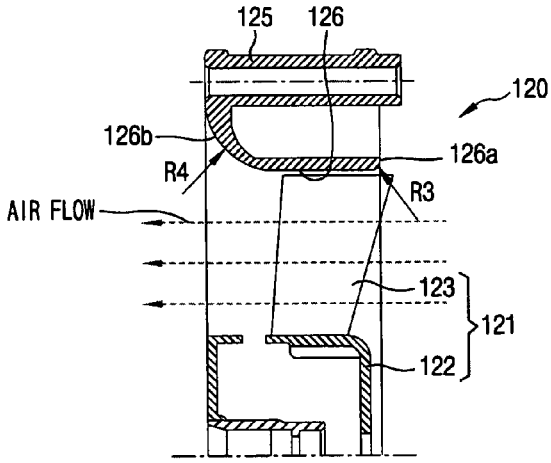
FIG. 4 is a side-sectional view illustrating a cooling fan in accordance with the present invention.
Figure 5:
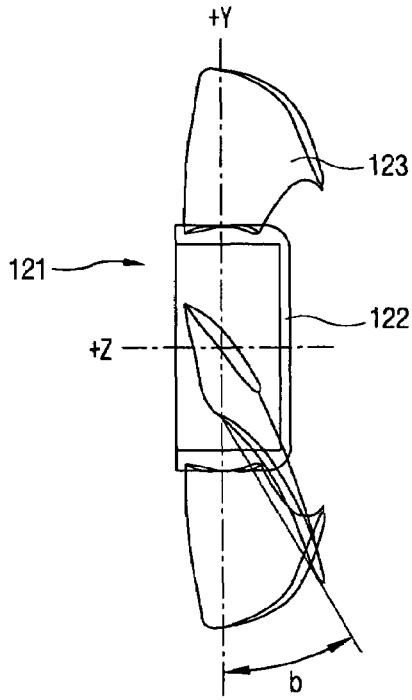
FIG. 5 is a side view illustrating a fan of FIG. 4.
Figure 6:
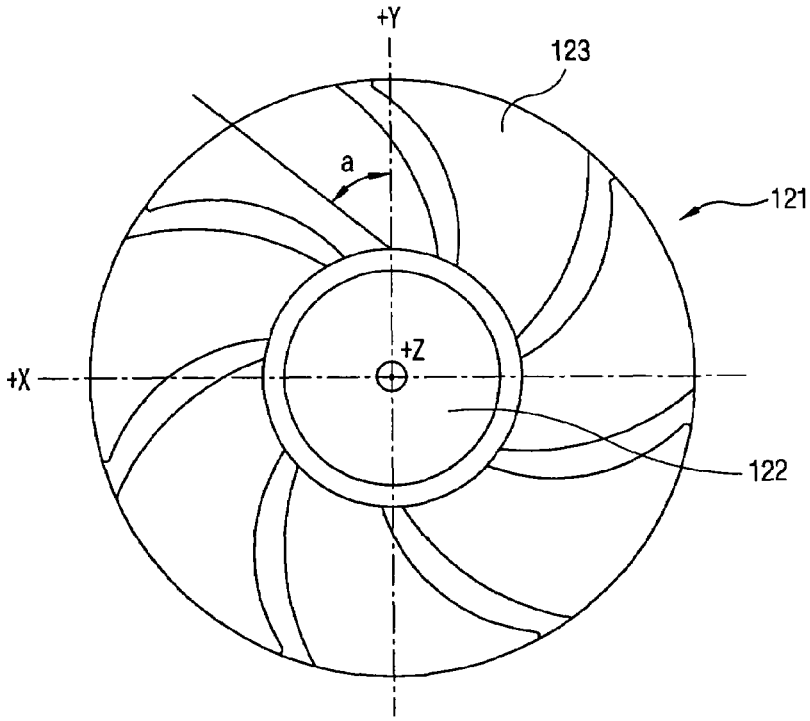
FIG. 6 is a front view illustrating the fan of FIG. 4.

FIG. 4 is a side-sectional view illustrating a cooling fan in accordance with the present invention, FIG. 5 is a side view illustrating a fan of FIG. 4, and FIG. 6 is a front view illustrating the fan of FIG. 4.

Referring to FIG. 4, an LCD projection TV having the cooling fan uses a lamp 1 having its outer circumference curved in the length direction as a light source. The lamp 1 is mounted in a lamp housing 10 installed at one side of an LCD display panel to be easily replaced and handled.

A cooling device for cooling the lamp 1 is disposed at the lamp housing 10 as follows.

A plurality of through holes 11 for discharging heat or exchanging heat with the open air are formed at both sides (or top and bottom surfaces) of the lamp housing 10. A cooling fan 120 for forcibly circulating the air is installed at the outer portion of the lamp housing 10, so that the air sucked through the through holes 11 formed at one side of the lamp housing 10 can efficiently exchange heat with the lamp 1.

The cooling fan 120 includes a fan 121 having a plurality of blades 123 protruded in the radial direction from an outer circumference of a hub 122 rotated by an inside motor (not shown), and a fan housing 125 having a through hole 126 formed in the thickness direction with a predetermined inside diameter, so that the fan 121 can be inserted and fixed thereto.

Both ends of the through hole 126 of the fan housing 125 have different curvature radiuses.

That is, still referring to FIG. 4, a curvature radius R3 of the end 126*a* of the inner circumference of the through hole 126 of the fan housing 125 sucking the air is smaller than a curvature radius R4 of the end 126*b* of the inner circumference of the through hole 126 discharging the air.

The fan housing 125 is formed in a square shape. A thickness of the fan housing 125 is about 30 to 35% of one side length of the outer portion of the fan housing 125.

In addition, an inside diameter of the through hole 126 formed at the center of the fan housing 125 is about 95 to 97% of one side length of the outer portion of the fan housing 125.

Preferably, the curvature radius R3 of the end 126*a* of the air inlet side ranges from 1 to 2 mm, and the curvature radius R4 of the end 126*b* of the air outlet side ranges from 9 to 13 mm.

As illustrated in FIGS. 5 and 6, the fan 121 includes the hub 122 connected to the motor (not shown), and the plurality of blades 123 protruded in the radial direction from the outer circumference of the hub 122 at predetermined intervals.

Preferably, a width of the fan 121 is about 70 to 75% of a width of the fan housing 125, and a diameter of the fan 121 is about 96 to 98% of the inside diameter of the through hole 126 formed on the fan housing 125.

A diameter of the hub 122 is 40 to 45% of the whole diameter of the fan 121.

On the other hand, seven blades 123 are preferably used. If necessary, more or less blades 123 can be designed.

As shown in FIG. 5, when the fan 121 is disposed in the vertical direction, an angle of the blade 123 bent from an Y axis direction to an X axis direction is a pitch angle (b) of a fan tip. Preferably, the blade 123 is formed so that the pitch angle (b) of the fan tip can range from 23 to 270.

As depicted in FIG. 6, when the fan 121 is disposed in the plane state, an angle of the rotary blade 123 bent from an Y axis direction to an X axis direction is a sweep angle (a). Preferably, the blade 123 is formed so that the sweep angle (a) can range from 38 to 42°.

Figure 13:
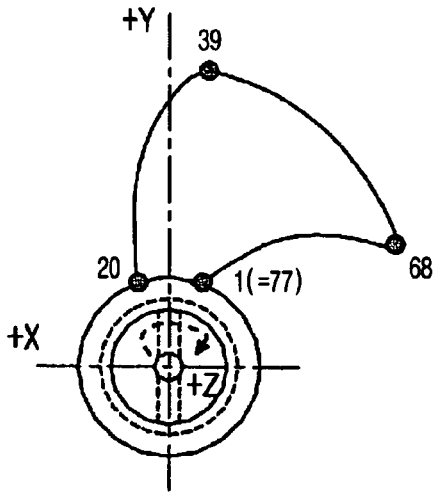
FIG. 13 is a chart showing boundary data of a rotary blade of FIG. 4.

In addition, the blade 123 has boundary data as shown in FIG. 13.

FIGS. 7 to 10 are graphs showing noise level variations by size variations of the fan 121 and the fan housing 125 of the cooling fan 120 mounted on the LCD projection TV in a predetermined flow rate (0.343CMM).

Figure 7:
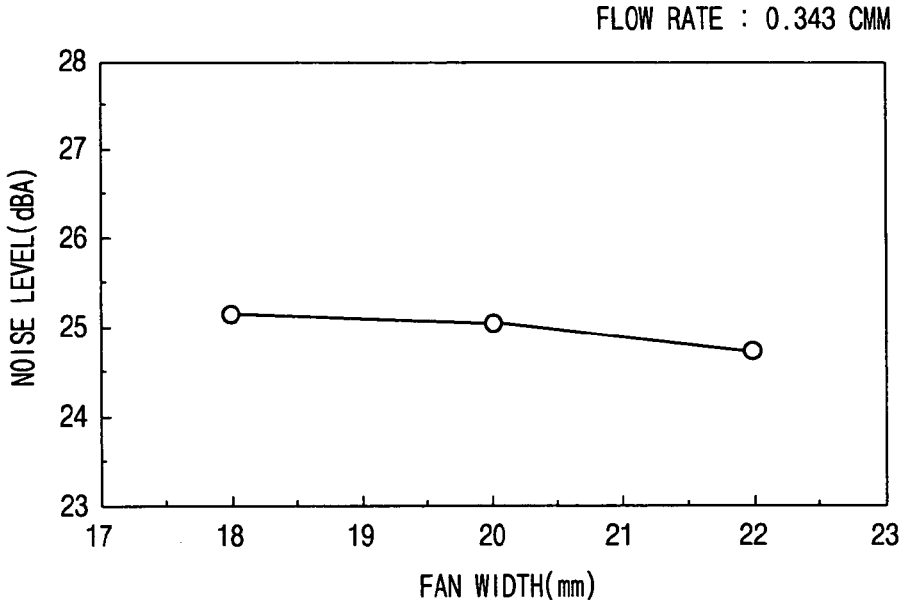
FIG. 7 is a graph showing noise variations by width variations of a fan in a predetermined flow rate.

FIG. 7 shows noise variations generated in the LCD projection TV by width variations of the fan 121 in a predetermined flow rate. When the width of the fan 121 increases, noises are slightly reduced.

Figure 8:
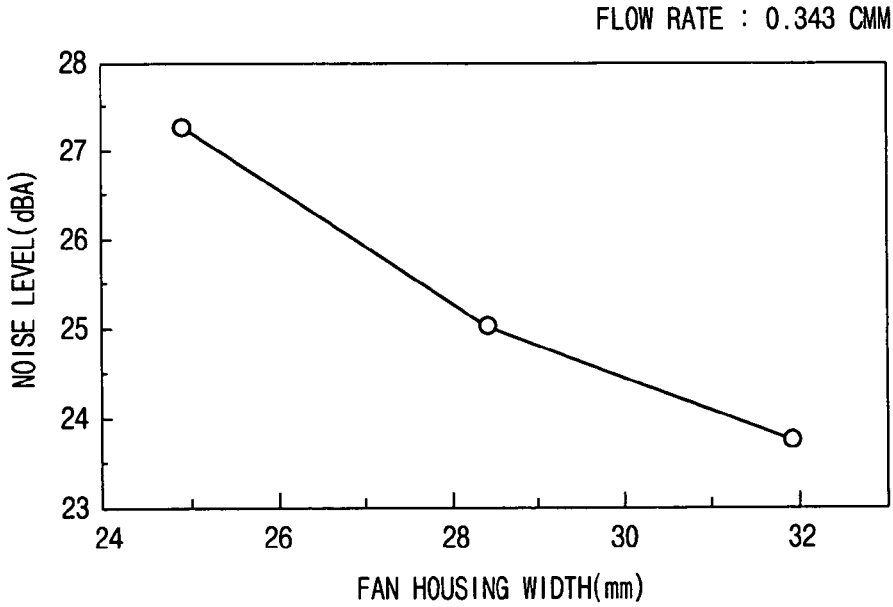
FIG. 8 is a graph showing noise variations by width variations of a fan housing in a predetermined flow rate.

FIG. 8 shows noise variations generated in the LCD projection TV by width variations of the fan housing 125 in a predetermined flow rate of the system. When the width of the fan housing 125 increases, noises are reduced. In the given range, when the width is about 32 mm, noises are minimized.

Figure 9:
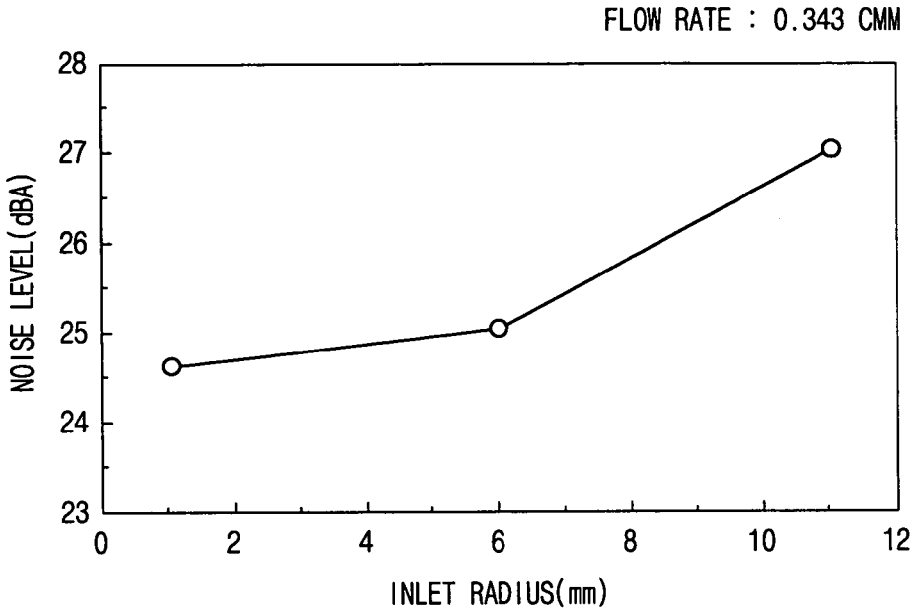
FIG. 9 is a graph showing noise variations by size variations of a curvature radius of the end of the inlet side of the inside diameter of the fan housing in a predetermined flow rate.

FIG. 9 shows noise variations generated in the LCD projection TV by size variations of the curvature radius R3 of the end 126*a* of the inner circumference of the through hole 126 of the fan housing 125 sucking the air in a predetermined flow rate. When the curvature radius R3 increases, noises sharply increase. In the given range, when the curvature radius R3 is about 1 mm, noises are minimized.

Figure 10:
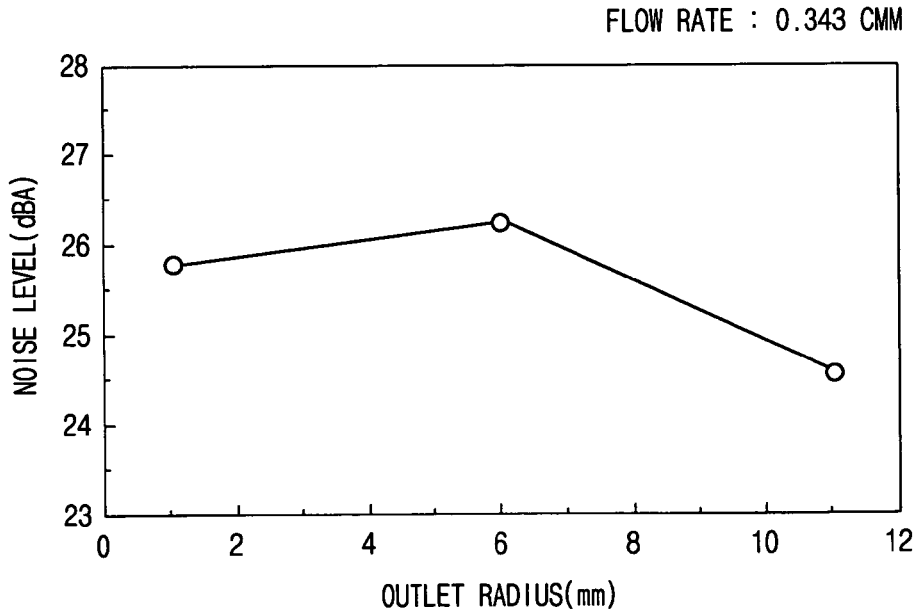
FIG. 10 is a graph showing noise variations by size variations of a curvature radius at the end of the outlet side of the inside diameter of the fan housing in a predetermined flow rate.

FIG. 10 shows noise variations generated in the LCD projection TV by size variations of the curvature radius R4 of the end 126*b* of the inner circumference of the through hole 126 discharging the air in a predetermined flow rate of the system. When the curvature radius R4 is equal to or smaller than 6 mm, noises slightly increase, and when the curvature radius R4 is larger than 6 mm, noises sharply decrease. In the given range, when the curvature radius R4 is about 11 mm, noises are minimized.

Figure 11:
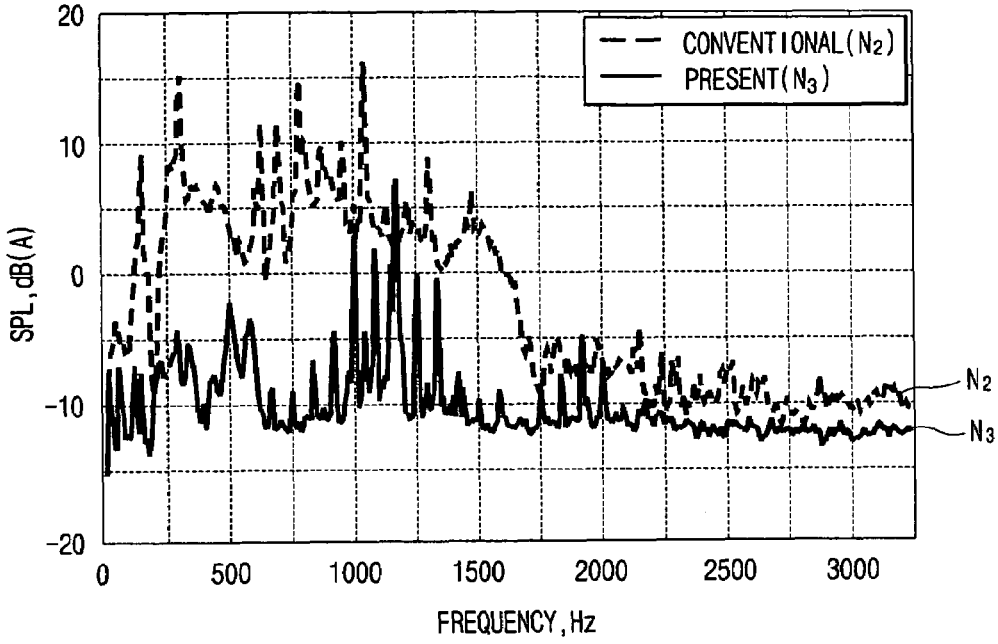
FIG. 11 is a graph showing noises generated by the conventional cooling fan and the cooling fan of the present invention, respectively.

FIG. 11 is a graph showing noises generated when the air is externally discharged from the conventional cooling fan 20 and the cooling fan 120 of the present invention, respectively. In the cooling fan 120 of the present invention, the sound level is broadly reduced in a low frequency region (0 to 1800 Hz).

Figure 12:
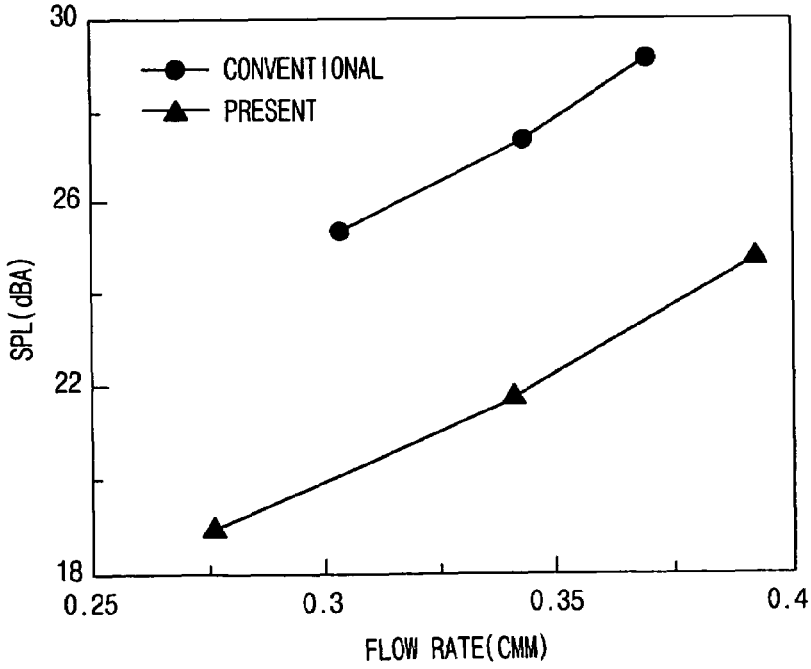
FIG. 12 is a graph showing sound pressure levels by the flow rates of the conventional cooling fan and the cooling fan of the present invention, respectively.

FIG. 12 is a graph showing sound pressure levels by the flow rates of the conventional cooling fan 20 and the cooling fan 120 of the present invention that are mounted on the LCD projection TV, respectively. In the whole flow rate range, noises are reduced by about 5.5 dBA.

The operation of the cooling fan 120 in accordance with the present invention will now be described.

When the fan 121 is rotated by supplying power to the cooling fan 120 mounted at one-side outer portion of the lamp housing 10, the air is sucked into the lamp housing 10 through the through holes 11 formed at one side of the lamp housing 10 by forcible circulation of the fan 121, absorbs the heat generated by the lamp 1 disposed in the lamp housing 10, and is externally discharged through the through hole 126 of the fan housing 125 of the cooling fan 120.

Here, the curvature radius R3 of the end 126*a* of the inner circumference of the through hole 126 of the fan housing 125 sucking the air is smaller than the curvature radius R4 of the end 126*b* of the inner circumference of the through hole 126 discharging the air, and the width of the fan housing 125 is optimized, thereby minimizing noises generated by the air externally discharged from the cooling fan 120.

Accordingly, the cooling fan mounted on the LCD projection TV can remarkably reduce noises when the user watches the TV.

As discussed earlier, in accordance with the present invention, the cooling fan mounted on the LCD projection TV minimizes noises generated by the air flow and increases users' satisfaction for the TV, by improving the shape of the fan housing, especially, the curvature radius of the end of the inner circumference of the fan housing and the width of the fan housing.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A cooling fan, comprising:

a fan rotated by a motor, for forcibly circulating the air; and a fan housing having a through hole formed in a thickness direction with a predetermined inside diameter so that the fan can be inserted and fixed thereto, wherein both ends of an inner circumference of the through hole are rounded with different curvature radiuses and a curvature radius of the end of the inner circumference of the through hole sucking the air is smaller than a curvature radius of the end of the inner circumference of the through hole discharging the air.

2. The cooling fan of claim 1, wherein the fan housing is formed in a square shape with a predetermined thickness.

3. The cooling fan of claim 2, wherein the thickness of the fan housing is 30 to 35% of one side length of the outer portion of the fan housing.

4. The cooling fan of claim 2, wherein the inside diameter of the through hole of the fan housing is 95 to 97% of one side length of the outer portion of the fan housing.

5. The cooling fan of claim 1, wherein the curvature radius of the end of the inner circumference of the through hole of the fan housing sucking the air ranges from 1 to 2 mm.

6. The cooling fan of claim 1, wherein the curvature radius of the end of the inner circumference of the through hole of the fan housing discharging the air ranges from 9 to 13 mm.

7. The cooling fan of claim 1, wherein a width of the fan is 70 to 75% of a width of the fan housing.

8. The cooling fan of claim 1, wherein a diameter of the fan is 96 to 98% of the inside diameter of the through hole formed on the fan housing.

9. The cooling fan of claim 1, wherein the fan comprises:

a hub connected to the motor; and a plurality of blades protruded in the radial direction from the outer circumference of the hub at predetermined intervals.

10. The cooling fan of claim 9, wherein a diameter of the hub is 40 to 45% of the whole diameter of the fan.

11. The cooling fan of claim 9, wherein the number of the blades is seven.

12. The cooling fan of claim 9, wherein each of the blades is formed so that a sweep angle can range from 38 to 42°.

13. The cooling fan of claim 9, wherein each of the blades is formed so that a pitch angle of a fan tip can range from 23 to 27°.

14. In an LCD projection TV including a lamp disposed inside a lamp housing installed at one side of an LCD display panel and used as a light source, and a cooling fan mounted at one side of the lamp housing, for circulating the air to cool heat generated by the lamp, the cooling fan, comprising:

a fan rotated by a motor, for forcibly circulating the air; and a fan housing having a through hole formed in a thickness direction with a predetermined inside diameter so that the fan can be inserted and fixed thereto, wherein both ends of an inner circumference of the through hole are rounded with different curvature radiuses and a curvature radius of the end of the inner circumference of the through hole sucking the air is smaller than a curvature radius of the end of the inner circumference of the through hole discharging the air.

* * * * *